US012179126B1

(12) United States Patent
Maritato

(10) Patent No.: US 12,179,126 B1
(45) Date of Patent: Dec. 31, 2024

(54) ANIMATED PROP AMUSEMENT APPARATUS WITH COMPACT DRIVE ASSEMBLY

(71) Applicant: Tekky, Orland Park, IL (US)

(72) Inventor: Mitch Maritato, Germantown, WI (US)

( * ) Notice: Subject to any disclaimer, the term of this patent is extended or adjusted under 35 U.S.C. 154(b) by 0 days.

(21) Appl. No.: 18/410,907

(22) Filed: Jan. 11, 2024

(51) Int. Cl.
*A63H 3/36* (2006.01)
*A63H 3/00* (2006.01)
*A63H 3/28* (2006.01)

(52) U.S. Cl.
CPC ..... *A63H 3/36* (2013.01); *A63H 3/006* (2013.01); *A63H 3/28* (2013.01); *A63H 2200/00* (2013.01)

(58) Field of Classification Search
CPC ..... A63H 7/00; A63H 11/06; A63H 13/16
USPC ..... 446/175, 308, 309, 310, 311, 487, 489
See application file for complete search history.

(56) References Cited

U.S. PATENT DOCUMENTS 2,320,302 A * 5/1943 Robins ..... G09F 19/08 446/309
2,985,975 A * 5/1961 Pike ..... G09F 15/0087 40/470
4,073,383 A * 2/1978 Rummer ..... A47F 7/166 40/473
5,101,215 A * 3/1992 Creaser, Jr. ..... E04H 12/182 52/118
5,454,202 A * 10/1995 van der Weijden .... G09F 17/00 70/57
6,247,991 B1 * 6/2001 Chen ..... G09F 19/02 74/89.22
6,312,308 B1 * 11/2001 Chen ..... A63H 33/00 428/3
6,422,915 B1 * 7/2002 Chen ..... A63H 33/00 446/175
6,491,567 B2 * 12/2002 Chan ..... A63H 33/06 446/478
6,572,432 B1 * 6/2003 Tsai ..... A63H 3/36 446/314
6,638,135 B2 * 10/2003 Fong ..... A63H 13/20 40/430
6,755,715 B2 * 6/2004 Wong ..... A47G 33/06 40/610
10,801,229 B1 * 10/2020 George, Sr. ..... E04H 12/32
11,395,977 B2 * 7/2022 Pruzansky ..... A63H 33/002
11,918,926 B2 * 3/2024 Pruzansky ..... A63H 29/24
11,935,434 B1 * 3/2024 Maritato ..... G09F 19/08
2009/0170620 A1 * 7/2009 Smith ..... A63B 57/30 473/150

* cited by examiner

*Primary Examiner* — Joseph B Baldori
(74) *Attorney, Agent, or Firm* — The Law Offices of Konrad Sherinian, LLC; Jeffrey S. Dixon

(57) ABSTRACT

An animated prop amusement apparatus with a stationary base, a drive assembly, and a prop mount for attaching an amusement prop. The drive assembly moves between retracted and extended positions to drive linear movements of the prop mount. The drive assembly includes a cylinder, a first extension link, and a second extension link interconnected by a pulley system so that extension of the of the first extension link from the cylinder drives extension of the second extension link from the first extension link. The drive assembly in the extended position is more than twice, and nearly three times, as long as the drive assembly in the retracted position.

8 Claims, 4 Drawing Sheets

ANIMATED PROP AMUSEMENT APPARATUS WITH COMPACT DRIVE ASSEMBLY

CROSS REFERENCE TO RELATED APPLICATIONS

None.

FIELD OF THE DISCLOSURE

The present invention generally relates to an amusement prop drive module and more particularly to a linear extension drive module for an amusement prop apparatus. Still more particularly, it relates to a compact linear-extension drive assembly that is capable of extending to more than twice an initial length of the drive assembly and to an animated prop amusement apparatus driven by the drive assembly.

SUMMARY OF THE DISCLOSURE

According to an aspect of the disclosure, an amusement apparatus comprises a support base, a drive assembly, and a prop mount. The drive assembly has a proximal end, a distal end, and a length extending from the proximal end to the distal end, the proximal end being connected to the support base. The prop mount is connected to the distal end of the drive assembly. The drive assembly is extendable and retractable in longitudinal extension and retraction directions to and from an extended position and a retracted position, the drive assembly having an extended length in the extended position and a retracted length in the retracted position, the extended length being more than twice the retracted length, to cause the prop mount to travel a longitudinal extension and retraction distance relative to the base equal to the extended length minus the retracted length. The drive assembly comprises a plurality of elongate links movably connected in series for movement relative to each neighboring one of the plurality of elongate links in the extension and retraction directions, the plurality of elongate links including a base link, a first extension link, and a second extension link, the base link being connected to the support base, the first extension link being so movably connected to the base link, the second extension link being so movably connected to the first extension link. The drive assembly further comprises at least a first pulley and at least a first tension member, the first pulley being affixed to the first extension link, the first tension member having a distal end attached to the second extension link and a proximal end attached to the base link, the first tension member being wrapped over the first pulley and having a distal segment extending in the retraction direction from the first pulley to the distal end and a proximal segment extending in the retraction direction from the first pulley to the proximal end, so that moving the first extension link relative to the base link in the extension direction by an input extension distance from a retracted position to an extended position, the retracted and extended positions being positions of the first extension link in the retracted and extended positions of the drive assembly, respectively, moves the first pulley by the input extension distance and shortens the first cable segment by the input extension distance to pull the second extension link the input extension distance toward the first pulley, so that the second extension link is moved twice the input extension distance relative to the base link. The drive assembly further comprises an input drive system operatively connected between the base link and the first extension link, the input drive system being operable to move the first extension link said input extension distance suddenly from the retracted position to the extended position so as to cause the second extension link to move suddenly twice said input extension distance and the prop mount to move suddenly at least twice said input extension distance, and to move the first extension link an input retraction distance, opposite side input extension distance, more gradually from the extended position to the retracted position so as to cause the second extension link to move more gradually twice side input retraction distance and the prop mount to move more gradually at least twice said input retraction distance.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

Figure 1:
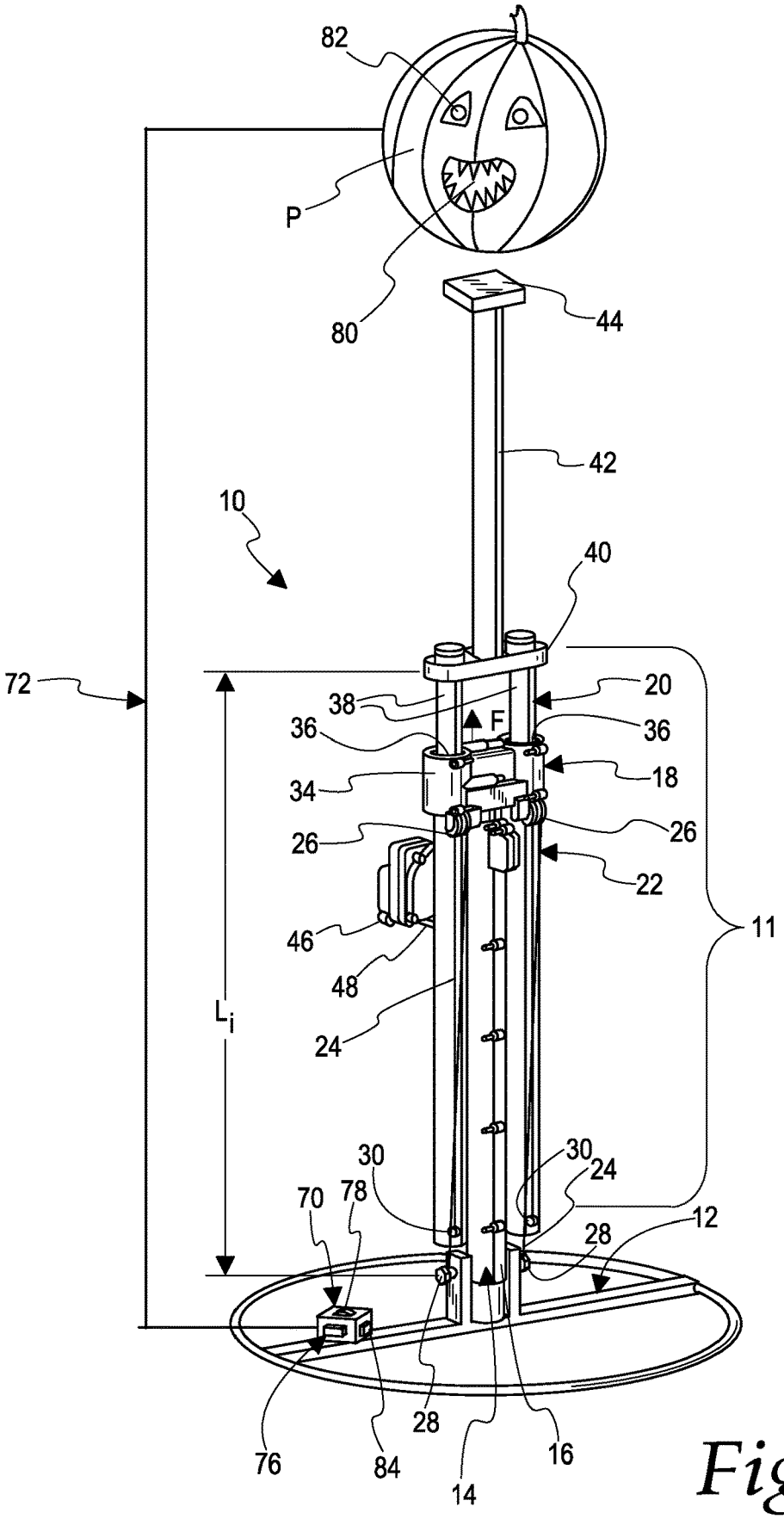
FIG. 1 is a front-top-right perspective view of an amusement apparatus according to an embodiment, in a retracted position.

A person of ordinary skill in the art will appreciate that elements of the figures above are illustrated for simplicity and clarity and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skills in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

In the following description of various examples of embodiments of the disclosed systems and methods, reference is made to the accompanying drawings, which form a part hereof, and in which are shown by way of illustration various example devices, systems, and environments in which aspects of the disclosed systems and methods can be practiced. Other specific arrangements of parts, example devices, systems, and environments, can be used, and structural modifications and functional modifications can be made without departing from the scope of the disclosed systems and methods.

Described here with reference to the accompanying drawing views of FIGS. 1-4 is an animated prop amusement apparatus 10 according to an embodiment of the disclosure.

The apparatus 10 includes a support base 12; a compact/extended-travel drive assembly 11 connected to the support base 12, the drive assembly 11 comprising a drive module 14 and an output extension link 20; a prop mount post 42 and prop mount 44 connected to the drive assembly 11; a prop P mounted to the prop mount 44, and an electrical system 70, the electrical system 70 comprising a power circuit 72 that operatively connects a power supply 76 and a control board 78 to the drive module 14, a sensor 80, a light 82, and a sounder 84. In operation, as described in greater detail below, when the control board 78 receives a signal from the sensor 80 detecting input such as sound or movement, power is directed from the power supply 76 to the drive module 14 to produce movement of the prop P, and to the light 82 and sounder 84 to produce a programmed sequence of lights and audio coordinated with the movement of the prop P.

Figure 2:
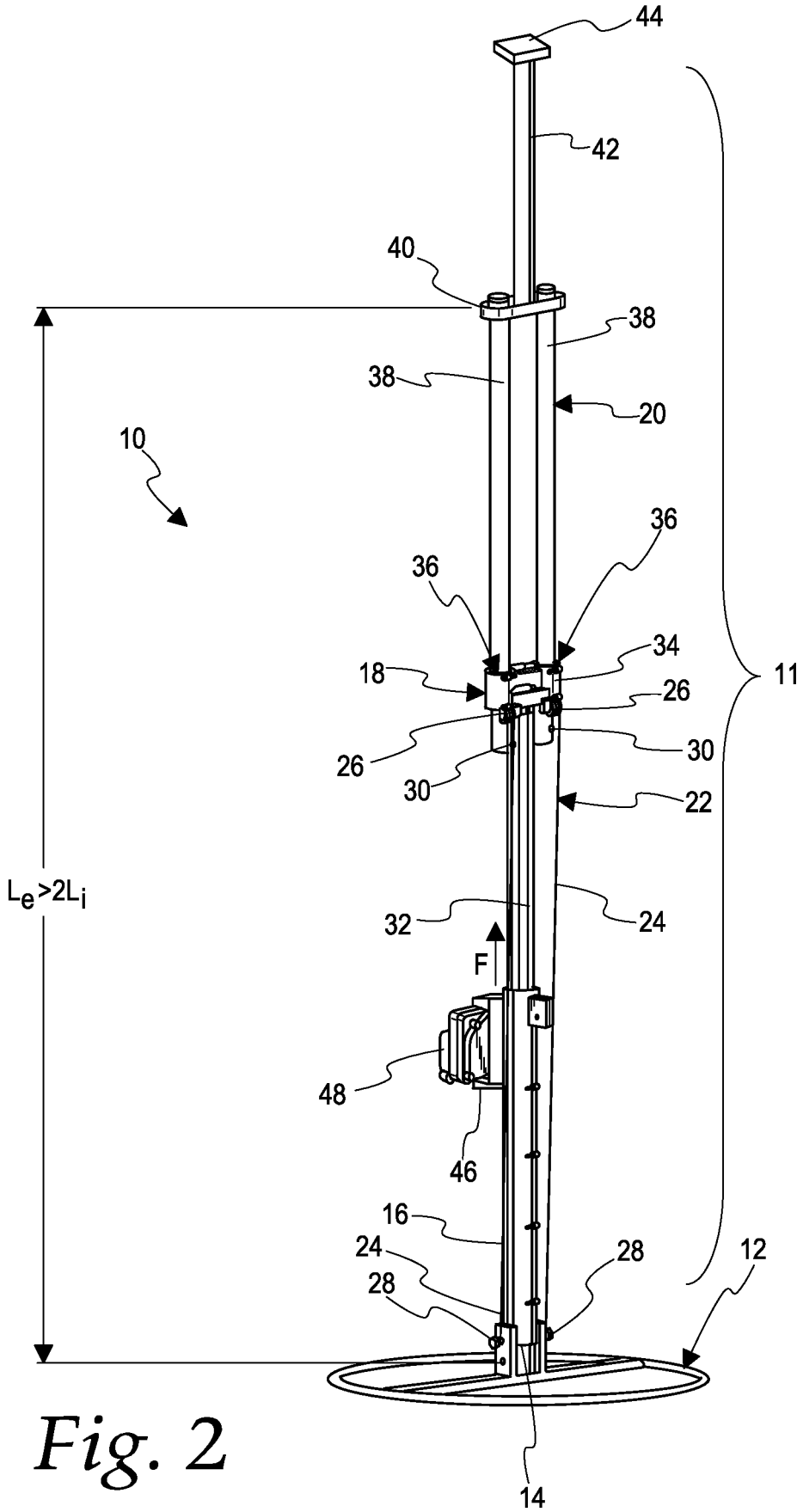
FIG. 2 is a front-top-right perspective view of the amusement apparatus of FIG. 1, in an extended position, omitting an electrical system and a prop.
Figure 3:
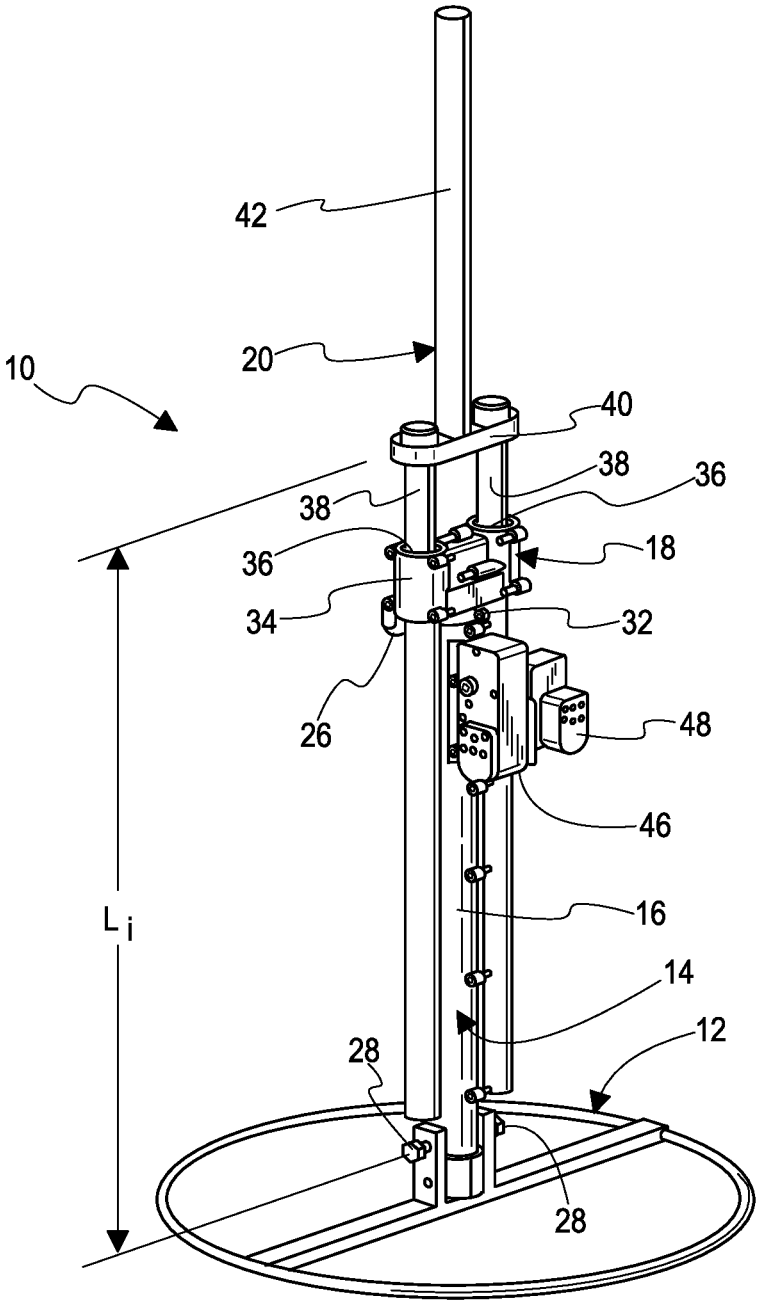
FIG. 3 is a rear-top-left perspective view of the amusement apparatus of FIG. 1 in the retracted position, omitting the electrical system, the prop, and a pulley cable.
Figure 4:
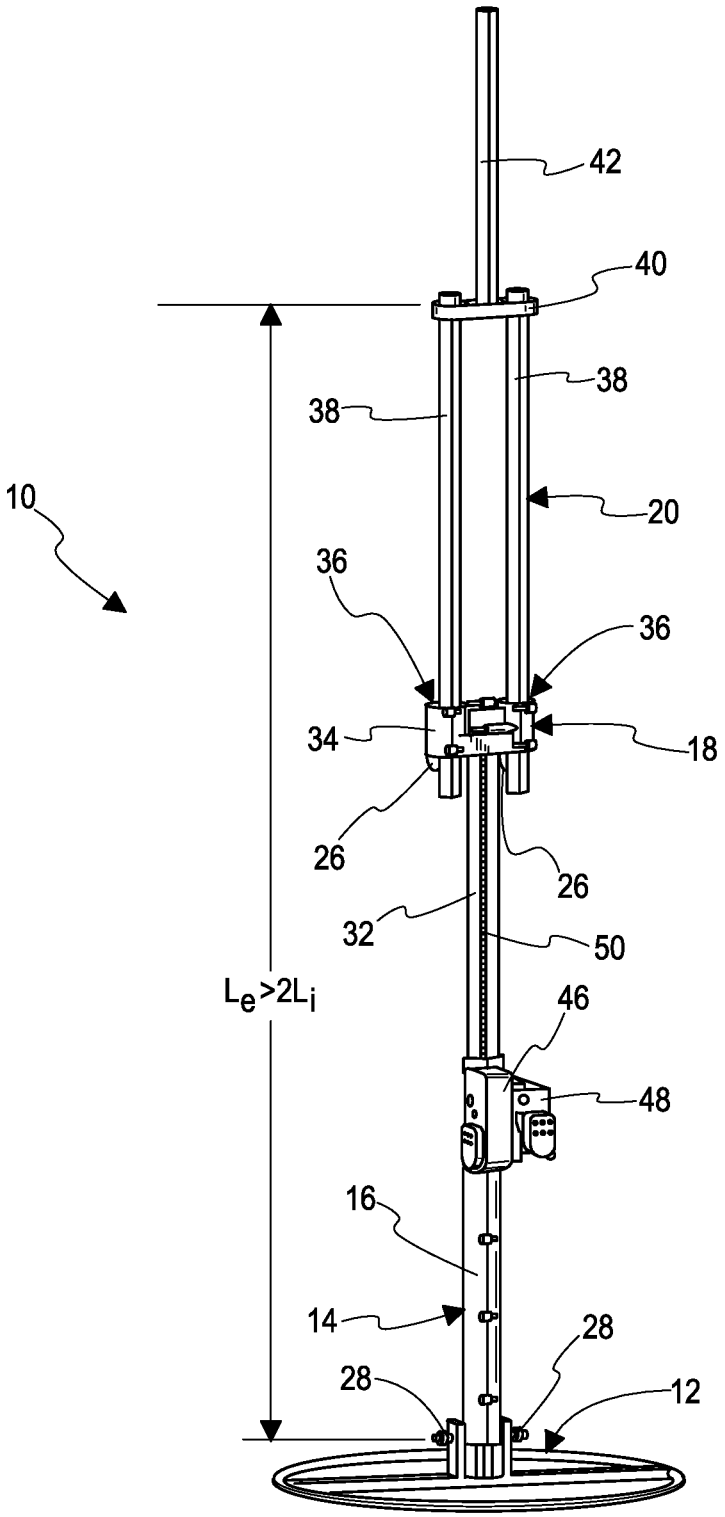
FIG. 4 is a rear-top-left perspective view of the amusement apparatus of FIG. 1 in the extended position, omitting the electrical system, prop, and pulley cable.

The drive assembly 11 comprises three interconnected elongate links having aligned length dimensions defining opposed longitudinal retraction and extension directions toward and away from the base 12, respectively. These are a cylinder 16 of the drive module 14, a first extension link 18, and a second or output extension link 20, shown in each of FIGS. 1-4. The cylinder 16 is fixedly (or optionally pivotally) connected to the base 12, the first extension link 18 is movably connected to the cylinder 16 for movement relative thereto in the retraction and extension directions, and the output extension link 20 is movably connected to the first extension link 18 for movement relative thereto in the retraction and extension directions. In FIGS. 1 and 3, the apparatus 10 is shown in a retracted position in which the drive assembly 11 has an initial length $L_i$, while in FIGS. 2 and 4, the apparatus 10 is shown in an extended position in which the drive assembly 11 has an extended length $L_e$, the extended length $L_e$ being more than twice the initial length $L_i$. More particularly, the extended length $L_e$ is nearly three times the initial length $L_i$, as the lengths of the three interconnected links 16, 18, 20 substantially overlap one another in the retracted position of the drive assembly 11 while minimally overlapping one another in the extended position. Put another way, the length of the drive assembly 11 in its extended position increases by more than, and by nearly two times, its initial length $L_i$ in its retracted position, which is also to say that the drive assembly 11 is operative to produce a linear travel distance ($L_e$–$L_i$) of the second/output extension link 20 greater than, and nearly two times, its initial length $L_i$.

It will be appreciated that the greatly expandable length of the drive assembly 11 makes it particularly advantageous for use in extending the linear travel distance of a prop in a "pop-up" type of amusement apparatus such as the apparatus 10, in which a prop P is primarily automated to spring straight up or out from a base 12. However, in other embodiments not shown, the drive assembly 11 can be incorporated into other types of prop-automation amusement apparatus, including more complex types in which linear extension of the drive assembly 11 connects to a linkage that can produce travel of a prop along a curved path, rotation of a prop, and/or relative articulation of interconnected parts of a prop.

The drive assembly 11 comprises a pulley system 22 including a cable 24, by which the second/output extension link 20 hangs from a pulley 26, the pulley 26 being affixed to the first extension link 18. More particularly, the first extension link 18 comprises an extension rod 32 of the drive module 14 (described in more detail below) and a yoke 34 affixed to an upper end of the extension rod 32, the pulley 26 in turn being affixed to the yoke 34. The cable 24 has a distal end attached to the output extension link 20, is wrapped over the pulley 26, and has a proximal end attached to a bolt 28 by which the cylinder 16 is fastened to the base 12 (alternatively, this end of the cable 24 could be attached to an attachment feature of the cylinder 16 or base 12, preferably positioned so that the cable 24 extends straight up from the attachment feature to the pulley 26).

Still more particularly, in the illustrated embodiment, the output extension link 20 comprises a pair of laterally spaced apart parallel uprights 38, each upright 38 being slidingly retained in a corresponding collar 36 formed in the yoke 34, the uprights 38 being joined together by a yoke 40 affixed to their respective upper ends above the yoke 34, and the pulley system 22 comprises two cables 24, a distal end of each cable 24 being attached to an attachment feature 30 formed in a respective one of the uprights 38 (illustrated as a hole 30 in the front side of each upright), the yoke 34 having a pair of pulleys 26 attached thereto, each pulley 26 retaining one of the cables 24. The pulleys 26 are laterally spaced apart so that each pulley 26 aligns with a respective one of the uprights 38, each cable 24 being wrapped over a respective one of the pulleys 26, and a second end of each cable 24 being attached to a respective end of the bolt 28 at opposite lateral sides of the cylinder 16.

Thus, as the first extension link 18 is extended from the cylinder 16, the length of a segment of each cable 24 extending between the pulley 26 and the cylinder 16 is increased, which in turn causes the length of a segment of the cable 24 between the pulley 26 to decrease by the same amount, as the total length of the cable 24 remains constant. The result of shortening the segment of the cable 24 connected to the output extension link 20 is to pull the second/output extension link 20 upward toward the pulley 26, while the pulley 26 itself is carried upward by the extension movement of the first extension link 18 to which it is affixed. In this manner an extension displacement distance of the first extension link 18 is amplified so that the second/output extension link 20 is displaced by twice that distance in the extension direction (relative to the cylinder 16). A prop mount post 42 is affixed to the output extension link 20 at an upper side of the yoke 40, and a prop mount 44 is in turn affixed to an upper end of the post 42, so that the drive assembly 11 is operative to produce extension or retraction travel of a prop P mounted to the prop mount 44 equal to the extension or retraction travel of the second/output extension link 20.

As noted above, in the illustrated embodiment, the output extension link 20 is a second extension link. Other embodiments can comprise three or more extension links connected in series to a base link, where the base link can be part of or connected to a support base, analogously to the cylinder 16, and an output link is the last link in the series. For example, to accommodate a third extension link, the yoke 40 could, be widened and have collars formed at its lateral ends analogous to the collars 36 of the yoke 34, for slidingly receiving a pair of uprights of the third extension link (which could be analogous to its own uprights 38), and a pair of pulleys could be attached to the yoke 40 for retaining a pair of cables, each cable attached at a distal end to the third extension link uprights and at a second end to, for example, an attachment feature on the yoke 34 of the first extension link 18. The post 42 would be omitted from the yoke 40 and instead an analogous prop mount post would be affixed to a yoke connecting the upper ends of the uprights of the third extension link. In such other embodiments, will be understood that, for each second and subsequent extension link added to the series, a cable is added to connect that link to the extension or base link two steps below, and an attached pulley is added to the extension link one step below, the added cable being wrapped over the pulley. In this manner, the extension travel of the first extension link is propagated through the series by causing each subsequent extension link to extend the same distance relative to the preceding extension link, so that each additional extension link adds the extension travel distance of the first extension link (which is typically nearly equal to the length of the first extension link) to the total extension travel of the drive assembly (i.e., that of its output link relative to its base link, also equal to its fully extended length minus its fully retracted length), while increasing the fully retracted initial length of the drive assembly by a significantly shorter distance, which may for example be on the order of a longitudinal dimension of a pair of collars, similar to that of the collars 36, added to retain a pair of uprights of a topmost extension link. Thus, for example, an additional extension link may increase the extended length of the drive assembly more than five times, or more than six times, a length by which it increases the retracted length of the drive assembly.

Input drive systems for driving an animated prop amusement apparatus according to the disclosure will now be described in greater detail, with particular reference to the illustrated embodiment of a linear drive module 14, as an example of an integrated drive module that comprises such an input drive system. A suitable input drive system includes a springing mechanism operative to produce sudden movement of a prop mount in one direction for a surprise effect, a motive device operative to produce more gradual movement of the prop mount in an opposite direction, and a transmission operative to transmit movement from the motive device to the prop mount. In embodiments, the springing mechanism and the motive device are separate mechanisms, the transmission is engageable and disengageable, such as by a suitable clutch mechanism, and, when engaged, the transmission is operative to restrain or substantially or wholly prevent movement or articulation not driven by the motive device, including that driven by the springing mechanism.

In more particular embodiments, including the illustrated embodiment, the springing mechanism comprises a biasing element that passively stores potential energy, such as a solid mechanical tension, compression, or torsion spring; weights hung from an input crank at a distance from its pivot point relative to a stationary base, to produce a desired biasing torque; or a volume of compressed gas, such as that of a gas spring or a pneumatic actuator. In such embodiments, the motive device is operative to gradually add potential energy to the biasing element by moving the input extension link in the retraction direction so as to retract the drive assembly, and a transmission disengagement mechanism (e.g., a clutch) is operative to release the stored potential energy suddenly by disengaging the transmission so as to decouple the position and movement of the motive device from the position and movement of a prop mount.

In other embodiments of an input drive system for an animated prop amusement apparatus, a pneumatic component produces extension and retraction movements at desired speeds, omitting an electromagnetic drive motor, a separate spring, and/or a clutch. In one embodiment, a suitable single acting pneumatic air cylinder component (not shown) suddenly expands or contracts its length when pressurized, while a return force from gravity or a return spring (which may be a separate spring component or part of the air cylinder component itself) reverses the expansion or contraction of the air cylinder component when air pressure is either entirely removed from the air cylinder component or sufficiently reduced to produce a an air cylinder force at a desired level less than that of the return force. Under the return force, the air cylinder component can be operative to reverse its sudden expansion or contraction equally suddenly or more gradually. In another embodiment, a pneumatic rotary actuator (not shown) drives desired prop travel or articulation, for example, by directly engaging a pivotal joint of a linkage. In another embodiment, a suitable dual acting pneumatic cylinder (not shown), activated by a compressor and a manual or solenoid valve or air switch, drives the desired prop movements. Optionally, air output from the compressor may be limited by the compressor itself or by a separate pressure regulator. The dual acting pneumatic cylinder may have its speed of extension and retraction controlled by a flow control valve, to control the speed of linkage articulations. The dual acting pneumatic cylinder obviates the need for a brake or clutch, as the cylinder ca drive bidirectional movements and can be pressurized rapidly enough to produce sudden prop movement even if it engages a prop mount or linkage before it is fully pressurized.

In the illustrated embodiment in particular, a biasing element, motive device, transmission, and clutch of an input drive system are embodied in a single integrated drive module, namely, the linear drive module 14. More particularly, the linear drive module 14 includes an elongate cylinder 16, an extension rod 32 movably mounted within the cylinder 16, the biasing element (hidden) being housed in the cylinder 16, the motive device and transmission being embodied in a motor module 46 mounted to the cylinder 16, and the clutch being embodied in a clutch module 48 mounted to the cylinder 16. The biasing element is connected between the extension rod 32 and cylinder 16 so as to bias the extension rod 32 to extend linearly from the cylinder 16. The motor module 46 is operative to transmit controlled movement of the motive device through the transmission to move the extension rod 32 relative to the cylinder 16, as well as to hold the extension rod 32 in place against a biasing force from the biasing element when the motive device is not in motion and the transmission is engaged. The clutch module 48 is operative to engage and disengage the transmission.

More particularly, the motor module 46 comprises an electric motor (hidden) as a motive device and a gear train (hidden) as a transmission, and the clutch module 48 is operative to engage and disengage the transmission by causing a clutch gear to mesh to and un-mesh from the gear train. The clutch module 48 comprises a motor operative to drive an eccentric clutch cam (not shown), which in turn is operative to cause the clutch gear to move axially into and out of plane with another gear of the gear train so as to mesh with and un-mesh from that gear. (A more detailed explanation of suitable drive and clutch modules of an analogous extension module is given in U.S. Pat. No. 11,148,067, the entire disclosure of which is hereby incorporated herein by reference.) As illustrated in FIGS. 1 and 2, the cylinder 16 of the linear drive module 14 is fixedly connected to the base 12. The extension rod 32 is slidably retained in the cylinder 16 so as to be movable in opposed longitudinal extension (up) and retraction (down) directions relative to the cylinder 16. The extension rod 32 can have a linear tooth rack 50, best shown in FIG. 4, that meshes with an output gear (hidden) of the motor module 46, so as to be driven by rotation of the output gear when the motive device is in motion and the transmission is engaged.

When the linear drive module 14 is so connected between the base 12 and the output extension link 20, with the transmission disengaged, the biasing element produces a biasing force F on the extension rod 32 to drive an input upward displacement of the first extension link 18, including the yoke 34 that carries the pulleys 26, thereby producing tension in the cable 24 between the attachment points 28 on the base 12 and the attachment features 30 on the output extension uprights 38, so as to drive local upward extension movement of the output extension link 20 relative to the first extension link 18, resulting in an amplified net upward output travel of the output extension link 20 equal to twice the input upward displacement of the first extension link 18.

Conversely, when the drive transmission is engaged and the motive device is in motion in a retraction/return direction, the motor module 46 is operative to rotate the output gear so as to drive the extension rod 32 to retract into the cylinder 16 in the retraction direction (down, with respect to FIGS. 1-4), in opposition to the biasing force F. This retraction of the extension rod 32 lowers the pulleys 26 so as to let out a length of slack in each cable 24 equal to about twice the downward displacement of the pulleys 26, thus allowing the output extension link 20 to passively descend to its home position with extension rod 32 fully retracted. In addition, as long as the transmission remains engaged, the motor module 46 is operative to restrain the output gear from rotating when the motive device is not in motion, so that the output gear bears against the linear tooth rack (hidden) so as to oppose the biasing force F and hold the extension rod 32 in its retracted position, thereby permitting the output extension link 20 to remain in its home position.

According to a system and method of use, the clutch module 48 is operative and operated to disengage the transmission when the output extension link 20 is in the home position, that is, when the extension rod 32 is fully retracted, to decouple the extension rod 32 from the motor module 46 and allow the biasing element of the linear drive module 14 to drive the input extension movement of the extension rod 32 and amplified net output extension travel of the output extension link 20. Conversely, the clutch module 48 is operative and operated to engage the transmission when the output extension link 20 reaches the upper end of its amplified net output extension travel, with the extension rod 32 likewise fully extended, to allow the motor module 46 to drive retraction of the extension rod 32 so as to restore potential energy to the biasing element. However, the clutch module 48 can be capable of engaging and disengaging the transmission at other positions of the extension rod 32 corresponding to other positions of the output extension link 20 (and thus other positions of the prop mount 44 in the illustrated embodiment, or in other embodiments, other positions of a connected linkage—not shown—that articulates to produce two-dimensional displacements and/or planar rotations of one or more attached prop members) and can be so operative and so operated according to other methods of use.

According to still another embodiment, the linear drive module 14 can be biased by the biasing element (not shown) to retract, and driven by the motor module 46 to extend, instead of the reverse as described above. In this embodiment, operating the clutch module 48 to disengage the transmission when the extension rod 32 is fully extended causes the prop mount 44 to drop down suddenly, while reengaging the transmission with the extension rod 32 fully retracted allows the motor module 46 to gradually raise the prop mount 44 back to an elevated home position as shown in FIG. 2.

As mentioned above, in embodiments in which the linear drive module 14 is biased to extend, the output extension link 20 is said to be in its home position when the extension rod 32 is fully retracted into the cylinder 16. Put another way, the fully retracted position of the extension rod 32 determines the home position of the output extension link 20. Conversely, the linear drive module 14 is typically adapted and configured so that the extension rod 32 at a fully extended position "tops out" against a suitable obstruction of the cylinder 16 to prevent its further extension. In embodiments, such topping out of the extension rod 32 can provide the sole mechanical stop limit to the extension of the drive assembly. In other embodiments, an amusement apparatus can include another mechanical stop, such as one or both of the uprights 38 of the output extension link 20 having a stop flange (not shown) of a larger diameter than the guide holes 36 of the extension yoke 34, so as to prevent further relative upward extension movement of the output extension link 20, and thus further upward input extension movement of the first extension link 18 (as this would drive the former relative movement), when the stop flange abuts the guide holes 36.

As mentioned above, the apparatus 10 further comprises the electrical system 70. The electrical system 70 includes a suitable power supply 76 (such as a battery, illustrated schematically in FIG. 2), a control board 78, a sensor 80, a light 82 (which may comprise, for example, a light emitting diode), and a sounder 84. The control board 78, sensor 80, light 82, and sounder 84 are operatively connected to the power supply 76, the sensor 80 being adapted and configured to detect an input signal and to transmit a sensor trigger signal to the control board 78 in response to detecting the input signal. The control board 78 is in turn adapted and configured to respond to the trigger signal by causing the clutch module 48 to disengage the transmission of the motor module 46 in response to receiving the sensor trigger signal from the sensor 80. For example, the control board 78 may cause a clutch motor of the clutch module 48 to be energized with current from the power supply 76 so as to rotate a clutch cam to a transmission disengagement position that disengages a clutch gear from a drive geartrain of the motor module 46.

Optionally, the electrical system 70 may include any suitable wired manual trigger (not shown), either in lieu of or in addition to the sensor 80, operable by a user to manually initiate transmission of the sensor trigger signal to the control board 78. A wired manual trigger may, for example, be a footpad (not shown) wrapped in a soft vinyl housing, which transmits vibrations generated by a user stepping on the footpad as a sound signal to a sound sensor associated with the control board 78, where the sound sensor thus signaled by the footpad may comprise the sensor 80 or an additional or alternative sensor not shown. Another type of wired footpad trigger may comprise electrical contact sheets spaced apart vertically by a compressible layer, e.g. foam, similarly wrapped in a soft vinyl housing, the compressible layer having holes through which the sheets come into contact. Other suitable manual triggers may include a hand-operated switch, such as a contact switch or a button.

At some point after the drive assembly 11 reaches its fully extended position (FIGS. 2 and 4), the control board 78 is further adapted and configured to activate the clutch module 48 to engage the drive transmission, to energize the motive device of the motor module 46 with current from the power supply 76 so as to transmit movement from the motive device to the extension rod 32, so as to cause the drive assembly 11 to retract from its fully extended position to its fully retracted position (FIGS. 1 and 3), and to cease the supply of energizing current from the power supply 76 to the motor module 46 when the drive assembly 11 reaches its retracted position. In addition, in response to the trigger signal the control board 78 is further adapted and configured to energize the light 82 and the sounder 84 with current from the power supply 76, to cause the light 82 and the sounder 84 to produce light and sound effects, such that the light and sound effects coordinate as desired with the movement and positions of the prop members as determined by the position of the drive assembly 11 (and thus, in other embodiments not shown in the drawings, of additional linkage operatively connected to the drive assembly 11 so as to produce prop articulation and/or further prop travel when driven thereby). Preferably, the light and sound effects are visible and audible to a person of normal, unaided vision and hearing, at a distance of ten feet, and more preferably at a distance of one hundred feet, from the apparatus 10.

The sensor 80 may be adapted and configured to detect any of a variety of suitable input signals as appropriate for a desired application of the apparatus 10. For example, the sensor 80 may be a "human sensor" that is operative to detect a passive infrared radiation (PIR) signal emitted from a person near the sensor 80, so as to surprise the person by triggering the apparatus 10 as the person approaches. In other embodiments, the sensor 80 may be operative to detect an audible sound signal, a visible light signal, a powered infrared signal emitted by a remote control, or a radio frequency signal. For example, the sensor 80 may be adapted and configured to detect a Bluetooth® Low Energy or Bluetooth® Classic signal (or equivalent UHF radio signal) emitted by a user's personal electronic device. Thus, for example, a human user may trigger the apparatus 10 from the user's smartphone or tablet.

The foregoing description of the disclosure has been presented for purposes of illustration and description and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this invention is much broader than presented by the claim (s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. An amusement apparatus comprising:

a support base;

a drive assembly having a proximal end, a distal end, and a length extending from the proximal end to the distal end, the proximal end being connected to the support base;

a prop mount connected to the distal end of the drive assembly;

the drive assembly being extendable and retractable in longitudinal extension and retraction directions to and from an extended position and a retracted position, the drive assembly having an extended length in the extended position and a retracted length in the retracted position, the extended length being more than twice the retracted length;

the drive assembly comprising a plurality of elongate links movably connected in series for movement relative to each neighboring link in the extension and retraction directions, the plurality of elongate links including a base link, a first extension link, and a second extension link, the base link being connected to the support base, the first extension link being movably connected to the base link, the second extension link being movably connected to the first extension link;

the drive assembly further comprising at least a first pulley and at least a first tension member, the first pulley being affixed to the first extension link, the first tension member having a distal end attached to the second extension link and a proximal end attached to the base link, the first tension member being wrapped over the first pulley and having a distal segment extending in the retraction direction from the first pulley to the distal end and a proximal segment extending in the retraction direction from the first pulley to the proximal end, so that moving the first extension link relative to the base link in the extension direction by an input extension distance from a retracted position of the first extension link to an extended position of the first extension link moves the first pulley by the input extension distance and shortens the distal segment by the input extension distance to pull the second extension link the input extension distance toward the first pulley, so that the second extension link is moved twice the input extension distance relative to the base link;

the drive assembly further comprising an input drive system operatively connected between the base link and the first extension link, the input drive system being operable to move the first extension link said input extension distance from its retracted position to its extended position and to move the first extension link an input retraction distance, opposite said input extension distance from its extended position to its retracted position;

the input drive system comprising a drive module including a biasing element, a motive device, and a transmission;

the biasing element being operatively connected between the base link and the first extension link so as to bias the first extension link to move in the extension direction;

the motive device and the transmission being operatively connected between the base link and the first extension link, the transmission being engageable when the drive assembly is in the extended position and disengageable when the drive assembly is in the retracted position;

the transmission being operative, when engaged, to transmit a movement of the motive device to the first extension link, so as to move the first extension link in the retraction direction relative to the base link, so as to retract the drive assembly, and when disengaged, to free the drive assembly to extend independently of the movement of the motive device.

2. The amusement apparatus of claim 1 wherein the second extension link comprises first and second parallel elongate uprights spaced apart in a lateral direction perpendicular to the longitudinal direction, the distal end of said first tension member being attached to the first upright, and the first tension member being wrapped over the first pulley, further comprising a second pulley and a second tension member, the second pulley being attached to the first extension link and spaced away from the first pully in said lateral direction, the second tension member having a distal end attached to the second upright and a proximal end attached to the base link, the second tension member being wrapped over the second pulley and having a distal segment extending in the retraction direction from the second pulley to the distal end and a proximal segment extending in the retraction direction from the second pulley to the proximal end.

3. The amusement apparatus of claim 1 wherein the first extension link comprises a first collar and a second collar laterally spaced away from the first collar, the first collar slidingly retaining the first upright of the second extension link, the second collar slidingly retaining the second upright of the second extension link.

4. The amusement apparatus of claim 1, further comprising a prop attached to the prop mount.

5. The amusement apparatus of claim 1, further comprising a control board, a sensor, and a power supply, the control board and sensor being operatively connected to the power supply, the sensor being adapted and configured to detect an input signal and to transmit a sensor trigger signal to the control board in response to detecting the input signal, the control board being adapted and configured to cause the transmission to be disengaged in response to receiving the sensor trigger signal from the sensor, and when the drive assembly is in the extended position, to cause the transmission to be engaged, the motive device to be moved, and the transmission to transmit the movement of the motive device to the drive assembly to cause the drive assembly to retract from the extended position to the retracted position.

6. The amusement apparatus of claim 5 wherein the sensor is adapted and configured to detect as the input signal a signal selected from the group consisting of a passive infrared radiation signal emitted from a human near the sensor, a sound signal, a visible light signal, a powered infrared signal emitted by a remote control, and a radio frequency signal.

7. The amusement apparatus of claim 5, further comprising a sounder, the control board being adapted and configured to cause the sounder to produce a sound when the input signal is detected by the sensor.

8. The amusement apparatus of claim 5, further comprising a light source, the control board being adapted and configured to cause the light source to emit visible light when the input signal is detected by the sensor.

* * * * *